United States Patent [19]

Colbath

[11] 3,945,232

[45]* Mar. 23, 1976

[54] ROLL-STAND FOR ROLL-FORMING MACHINE

[76] Inventor: Dan L. Colbath, P.O. Box 1003, Sherman, Tex. 75090

[ * ] Notice: The portion of the term of this patent subsequent to July 31, 1990, has been disclaimed.

[22] Filed: Apr. 5, 1974

[21] Appl. No.: 458,295

Related U.S. Application Data

[63] Continuation-in-part of Ser. No. 355,673, April 30, 1973, Pat. No. 3,823,592, which is a continuation-in-part of Ser. No. 181,838, Sept. 20, 1971, Pat. No. 3,748,884.

[52] U.S. Cl. ..... 72/181

[51] Int. Cl.[2] ..... B21D 5/08

[58] Field of Search ..... 72/181, 182, 179, 178, 72/247

[56] References Cited

UNITED STATES PATENTS

| | | | |
|---|---|---|---|
| 1,317,581 | 9/1919 | Kipniss et al. | 72/178 |
| 2,176,115 | 10/1939 | Yoder | 72/181 |
| 2,294,324 | 8/1942 | Wilkens et al. | 72/181 X |
| 3,006,224 | 10/1961 | Celovsky | 72/249 |
| 3,472,053 | 10/1969 | Chang | 72/178 |
| 3,635,064 | 1/1972 | Chang | 72/178 |
| 3,748,884 | 7/1973 | Colbath | 72/181 |
| 3,823,592 | 7/1974 | Colbath | 72/181 |

*Primary Examiner*—Milton S. Mehr

*Attorney, Agent, or Firm*—Richards, Harris & Medlock

[57] ABSTRACT

A roll-forming machine includes a plurality of roll-stands for moving material along a predetermined path and a plurality of die-stands for progressively transforming the material from an initial configuration to a desired configuration. The die-stands are mounted on and positioned by an elongate, rigid spine which permits conversion of the machine from one roll-forming configuration to another by replacing the spine and the die-stands mounted thereon with a different spine/die-stand assembly.

The roll-stands each include at least a pair of lower rollers which are selectively positionable transversely with respect to the predetermined path to accommodate materials of various widths in the roll-forming machine. In certain embodiments of the invention each roll-stand further includes a pair of upper rollers which are floatingly supported to accommodate materials of various thicknesses in the roll-forming machine and which are selectively positionable transversely with respect to the predetermined path and in alignment with the lower rollers. In other embodiments idler rollers are mounted on the spine for cooperation with the lower rollers to drive material through the roll-forming machines. The roll-stands may be actuated either by means of a common drive system or by means of individual drive motors.

27 Claims, 13 Drawing Figures

ROLL-STAND FOR ROLL-FORMING MACHINE

CROSS REFERENCE TO RELATED APPLICATION

This application is a continuation-in-part of co-pending application Ser. No. 355,673, filed Apr. 30, 1973 now U.S. Pat. No. 3,823,592, which is a continuation-in-part of application Ser. No. 181,838, filed Sept. 20, 1971, now U.S. Pat. No. 3,748,884.

BACKGROUND AND SUMMARY OF THE INVENTION

U.S. Pat. No. 3,748,884, granted to Dan L. Colbath on July 31, 1973, discloses a roll-forming machine including a plurality of roll-stands each comprising cooperating non-forming rollers which function to move material along a predetermined path. The roll-forming machine further includes a plurality of die-stands each comprising non-driven material engaging rollers which function to transform the material from an initial configuration to a desired configuration. The die-stands are mounted on and positioned relative to the path by an elongate, rigid spine. This permits conversion of the machine from one roll-forming configuration to another by removing the spine and the die-stands attached thereto and then installing a different spine/die-stand assembly in the roll-forming machine.

In co-pending application Ser. No. 355,673 there is disclosed a roll-forming machine also including roll-stands for transporting material along a predetermined path and die-stands for progressively transforming the material from an initial configuration to a desired configuration. The roll-forming machine is similar to that described above in connection with U.S. Pat. No. 3,748,884 in that the die-stands are mounted on a rigid spine to facilitate conversion of the roll-forming machine from one roll-forming configuration to another. A major difference between the two roll-forming machines relates to the fact that in the latter machine the roll-stands comprise nonforming lower driving rollers only. Idler rollers are mounted on the spine for cooperation with the lower driving rollers to drive material through the roll-forming machine.

Although roll-forming machines incorporating the abovedescribed invention have enjoyed substantial commercial success, certain problems have been encountered in their use. For example, in both machines the positioning of the material driving rollers of the roll-stands transversely relative to the direction of material movement is fixed. This is somewhat limiting with respect to the width of materials that can be accommodated in the roll-forming machine. Another problem relates to the fact that in both of the prior roll-forming machines employ a common drive system for all of the roll-stands. This has been found to be somewhat cumbersome with respect to subsequent changes in the number and/or the positioning of the roll-stands.

The present invention comprises improvements in roll-stands for roll-forming machines which overcome these and other problems of the prior art. In accordance with the broader aspects of the invention, a roll-stand comprises at least one lower roller which is selectively positionable transversely with respect to the path of material movement through the roll-forming machine. By this means materials of various widths are accommodated in the roll-forming machine. The roll-stands may be actuated either by means of a common drive system or by means of individual drive motors each drivingly connected to the roller in one of the roll-stands.

In accordance with more specific aspects of the invention, each roll-stand may further include a pair of upper rollers which are floatingly supported so as to accommodate materials of various thicknesses in the roll-forming machine. In such instances the upper rollers are also selectively positionable transversely relative to the path of material movement and are driven either by the common power source or by an individual drive motor. Alternatively, there may be provided idler rollers mounted on the spine for cooperation with the lower rollers to move material through the roll-forming machine.

The material driving rollers of the roll-stands may be arranged in pairs, and each roller rotatably supported by a bearing block. The bearing blocks are selectively positionable transversely with respect to the direction of material movement. A drive shaft extends through each pair of rollers and structure is provided for constraining the rollers to rotation with the drive shaft. The drive shaft is in turn drivingly connected either to a drive system common to all of the roll-stands or to a drive motor individual to the associated pair of rollers.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
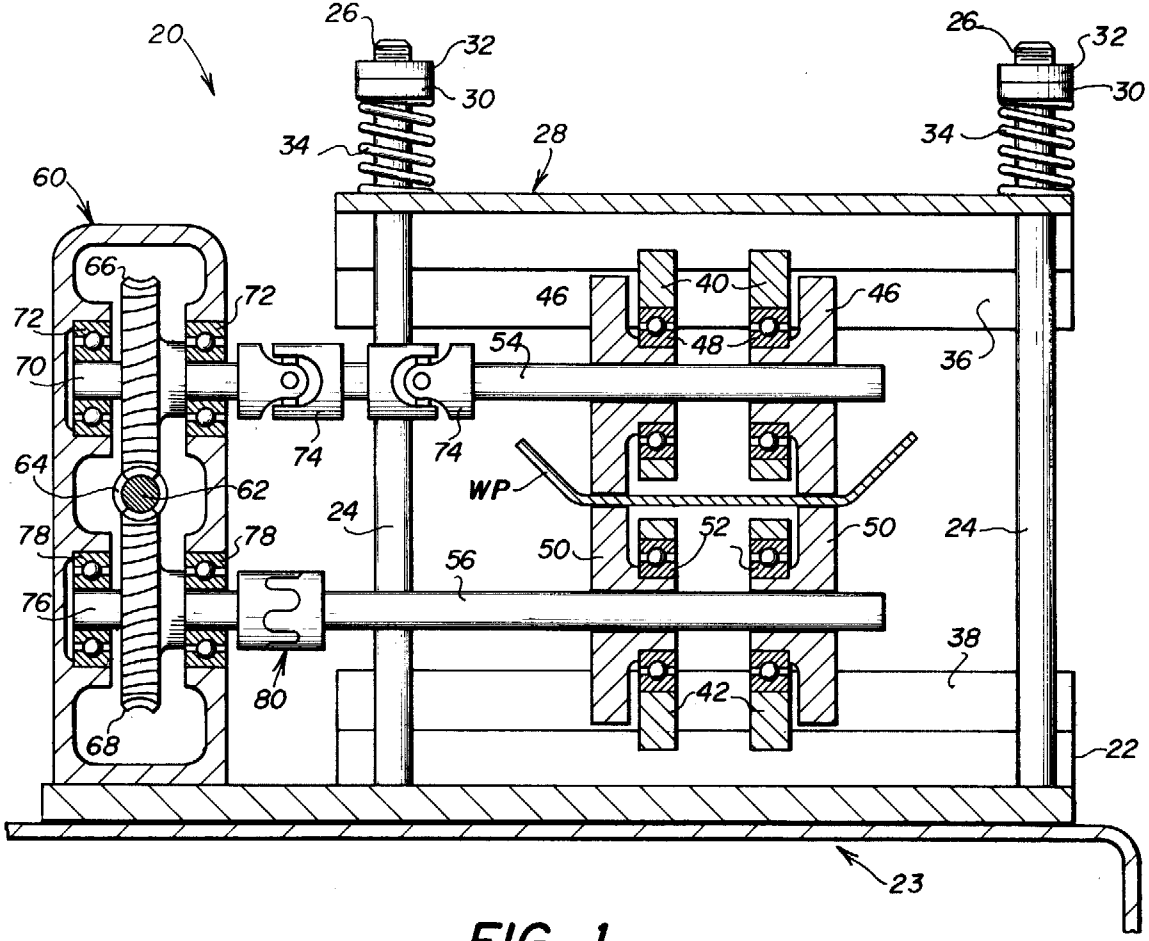
FIG. 1 is an illustration of a roll-stand incorporating a first embodiment of the invention in which certain parts have been broken away more clearly to illustrate certain features of the invention.

Referring now to the Drawings, and particularly to FIG. 1 thereof, there is shown a roll-stand 20 incorporating a first embodiment of the invention. The roll-stand 20 includes a base 22 which is mounted on the frame 23 of a roll-forming machine incorporating the roll stand. The base 22 includes four vertically extending guide posts 24. A threaded portion 26 is formed at the upper end of each guide post 24.

A cap piece 28 is slidably supported on the guide posts 24. A nut 30 and a lock nut 32 are threadedly engaged with the threaded portion 26 at the upper end of each guide post 24, and a compression spring 34 is positioned between the cap piece 28 and each nut 30. This permits the cap piece 28 to move upwardly on the guide posts 24 against the action of the springs 34.

Figure 2:
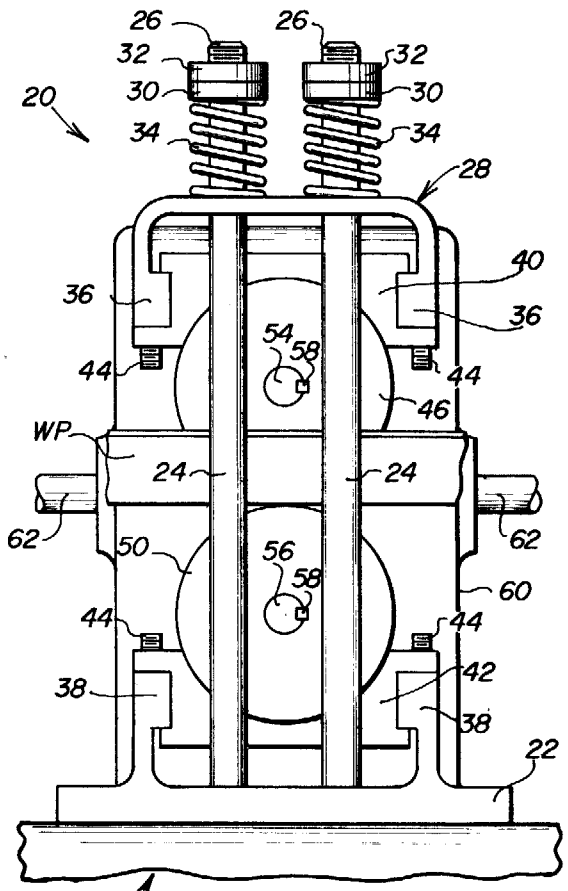
FIG. 2 is a side view of the roll-stand shown in FIG. 1.

Referring to FIG. 2, upper and lower ways 36 and 38 are formed integrally with the cap piece 28 and the base 22, respectively. A pair of upper bearing blocks 40 are received in the ways 36 and a pair of lower bearing blocks 42 are received in the ways 38. The bearing blocks 40 and 42 are slidably supported in the ways 36 and 38, respectively, but are normally secured against movement relative to the ways by set screws 44, or the like.

Referring again to FIG. 1, a pair of upper rollers 46 are rotatably supported in the upper bearing blocks 40 by means of anti-friction bearings 48. Similarly, a pair of lower rollers 50 are rotatably supported in the lower bearing blocks 42 by means of anti-friction bearings 52. By this means, the rollers 46 and 50 are adapted to receive a workpiece WP therebetween and drive the workpiece through a roll-forming machine incorporating the roll-stand 20. It will be noted in this regard that since the cap piece 28 is slidably supported on the guide posts 24, the upper rollers 46 are floatingly supported and are adapted to move upwardly against the action of the springs 34, thereby accommodating workpieces by various thicknesses in the roll-forming machine.

An upper drive shaft 54 extends through both of the upper rollers 46 and a lower drive shaft 56 extends through both of the lower rollers 50. As is best shown in FIG. 2, the drive shafts and the rollers are provided with suitable keyways which receive keys 58. Thus, by means of the bearing blocks 40 and 42 and the keys 58, the rollers 46 and 50 are selectively positionable axially along the drive shafts 54 and 56 but are constrained to rotation with the drive shafts.

A gearbox 60 is supported on the base 22. A worm shaft 62 extends through the gearbox 60 and functions to drive a worm 64. The worm 64 is mounted in mesh both with an upper worm wheel 66 and with a lower worm wheel 68.

The upper worm wheel 66 is secured to a shaft 70 which is rotatably supported in the gearbox 60 by anti-friction bearings 72. The shaft 70 is drivingly connected to the upper drive shaft 54 by means of a pair of universal joints 74. This permits the upper drive shaft 54 to move upwardly with the upper rollers 46 in order to accommodate materials of various thicknesses in a roll-forming machine incorporating the roll-stand 20.

The lower worm wheel 68 is secured to a shaft 76 which is rotatably supported in the gearbox 60 by anti-friction bearings 78. The shaft 76 is connected to the lower drive shaft 56 by means of a coupler 80. It will be understood that by disengaging the coupler and one or both of the universal joints 74, the operating components of the roll-stand 20 may be removed from the components housed within the gearbox 60, such as for maintenance purposes, etc., and the entire roll-stand 20, including the gearbox 60, may be removed from the frame 23 for replacement or maintenance etc.

Figure 3:
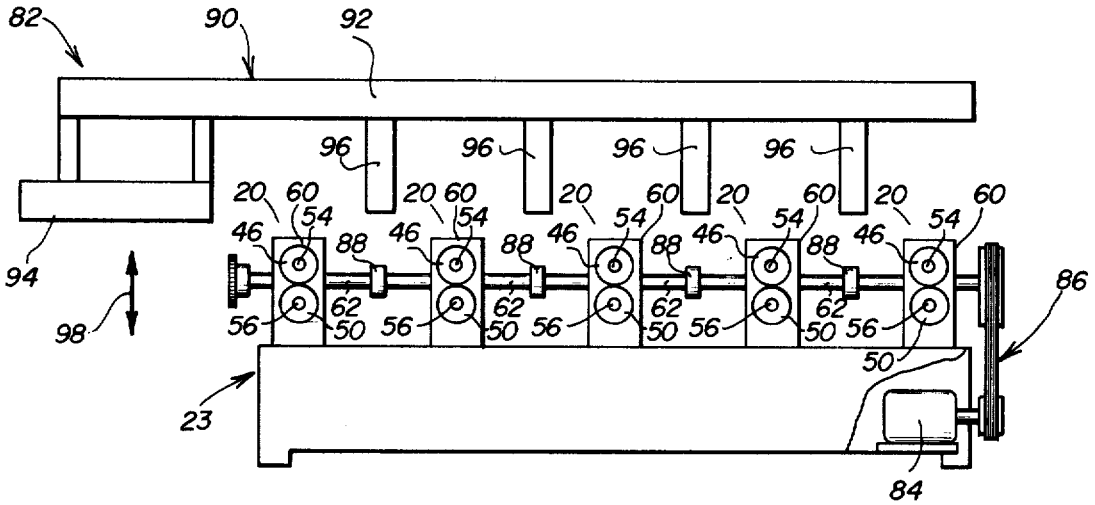
FIG. 3 is a somewhat diagrammatic illustration of a roll-forming machine incorporating roll-stands of the type shown in FIG. 1.

In FIG. 3 there is shown a roll-forming machine 82 incorporating a plurality of roll-stands 20 of the type illustrated in FIGS. 1 and 2. The roll-stands 20 are supported on a common frame 23 which also supports the remaining components of the roll-forming machine 82. A drive motor 84, which may be an electric motor, a hydraulic motor, a pneumatic motor, etc., is mounted on the frame 23 and is drivingly connected to the worm shaft 62 of the endmost roll-stand 20 by a V-belt drive system 86. The worm shafts 62 of the various roll-stands 20 are in turn connected one to the other by conventional couplers 88.

The roll-forming machine 82 further comprises a spine/die-stand assembly 90. The assembly 90 includes an elongate, rigid spine 92 which supports a guide assembly 94 and a plurality of die-stands 96. The guide assembly 94 functions to guide material into the roll-forming machine 82. Each die-stand 96 comprises one or more non-driven material engaging rollers.

As indicated by the arrow 98, the spine 92 of the spine/die-stand assembly 90 engages the frame 23 and functions to properly position the guide assembly 94 and the die-stands 96 relative to the roll-stands 20. The guide assembly 94 and the roll-stands 20 then function to define a predetermined path of material movement through the roll-forming machine 82. The roll-stands 20 operate under the action of the drive motor 84 to drive material through the roll-forming machine. During movement of material along the predetermined path, the non-driven material engaging rollers of the die-stands 96 function to transform the material from an initial configuration to a desired configuration.

At such time as it is desired to convert the roll-forming machine 82 to one roll-forming configuration to another, the spine/die-stand assembly 90 is disengaged from the frame 23 and is removed from the roll-forming machine 82 in the manner indicated by the arrow 98. A different spine/die-stand assembly 90 is then installed in the roll-forming machine 82, whereupon the machine is adapted to perform a completely different roll-forming operation. A more complete understanding of the construction and operation of the roll-forming machine 82 may be had by reference to U.S. Pat. No. 3,748,884, granted July 31, 1973, the disclosure of which is incorporated herein by reference.

A primary advantage deriving from the use of roll-stands 20 of the type shown in FIGS. 1 and 2 in the roll-forming machine 82 relates to the fact that the upper rollers 46 and the lower rollers 50 of each roll-stand 20 may be selectively located in predetermined positions transversely relative to the path of material movement through the roll-forming machine. By this means materials of various widths may be received and driven by the roll-stands 20. This in turn facilitates the use of the roll-forming machine 82 in a substantially greater number of roll-forming operations than would be possible if the upper and lower rollers of the roll-stands were fixedly positioned transversely relative to the path of material movement through the roll-forming machine.

A secondary advantage lies in the manufacture of the roll-forming machine in that the roll-stands are of "unit" construction and may be standardized and stocked. The final assembly would then consist of mounting one or more standard roll-stands on a "custom" frame.

Figure 5:
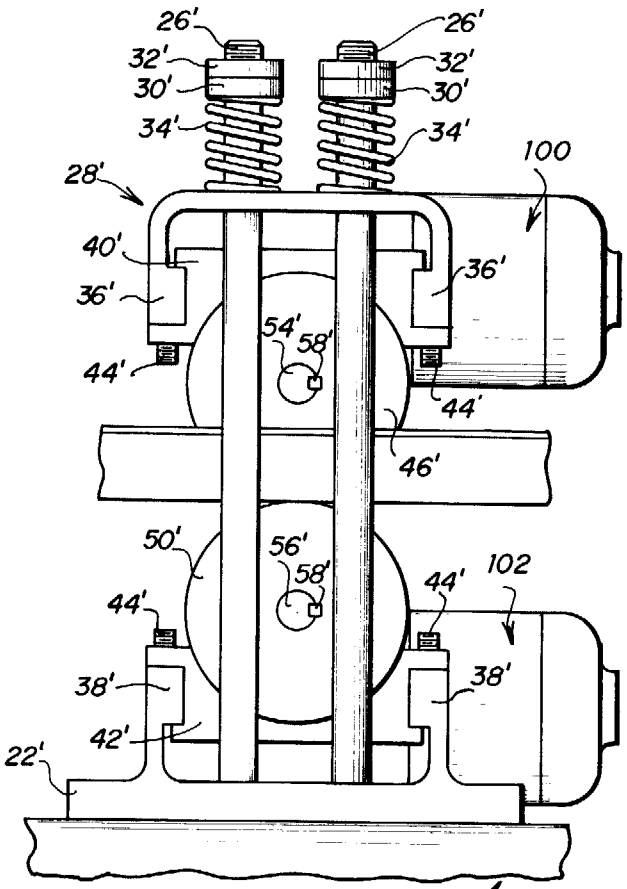
FIG. 5 is a side view of the roll-stand shown in FIG. 4.
Figure 4:
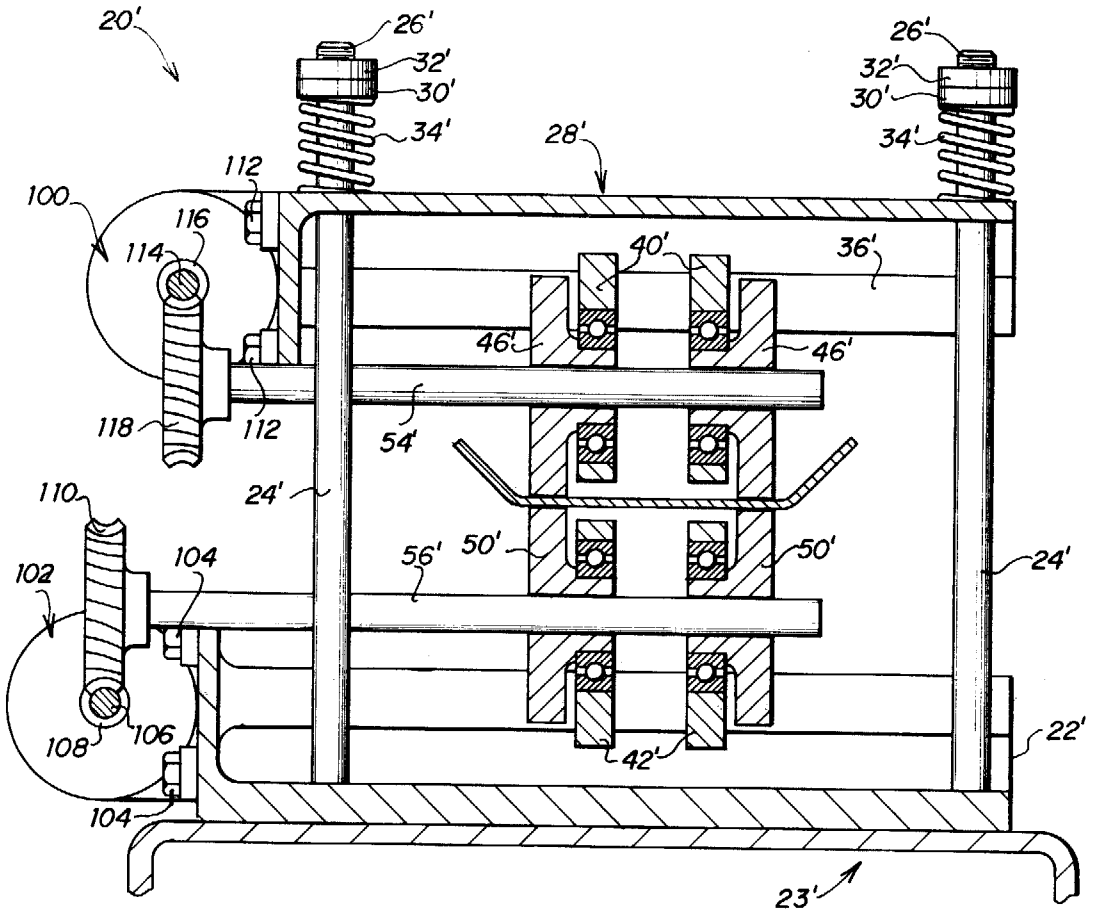
FIG. 4 is an illustration of a roll-stand incorporating a second embodiment of the invention in which certain parts have been broken away.

A roll-stand 20′ incorporating a second embodiment of the invention is illustrated in FIGS. 4 and 5. Many of the component parts of the roll-stand 20′ are equivalent in construction and function to component parts of the roll-stand 20 illustrated in FIGS. 1 and 2. Such equivalent parts are indicated by reference numerals identical to those utilized hereinbefore in connection with the description of the roll-stand 20, but are differentiated from the component parts of the roll-stand 20 by means of a prime (′) designation.

The primary distinction between the roll-stand 20′ and the roll-stand 20 relates to the fact that rather than incorporating a common drive system, the roll-stand 20′ utilizes individual drive motors 100 and 102 to actuate the upper and lower rollers 46′ and 50′, respectively. The motor 102 is secured to the base 22′ by fasteners 104 and has an output shaft 106. A worm 108 is mounted on and driven by the shaft 106. A worm wheel 110 is mounted in mesh with the worm 108 and is in turn connected to the lower drive shaft 56′. Thus, the motor 102 operates through the output shaft 106, the worm 108, the worm wheel 110, and the lower drive shaft 56′ to effect rotation of the lower rollers 50′.

The drive motor 100 is secured to the cap piece 28′ by fasteners 112 and has an output shaft 114. A worm 116 is mounted on and driven by the shaft 114. A worm wheel 118 is mounted in mesh with the worm 116 and is in turn secured to the upper drive shaft 54′. Thus, the drive motor 100 operates through the output shaft 114, the worm 116, the worm wheel 118, and the upper drive shaft 54′ to actuate the upper rollers 46′. Since the drive motor 100 is mounted on the cap piece 28′, the entire drive system for the upper rollers 46′ is free to float upwardly with the rollers 46′ against the action of the springs 34′, thereby accommodating materials of various thicknesses in the roll-stand 20′.

The roll-stand 20′ incorporates the same advantages over the prior art as the roll-stand 20. Thus, the upper and lower rollers 46′ and 50′ of the roll-stand 20′ may be selectively located in predetermined positions transversely relative to the path of movement of material through a roll-forming machine incorporating the roll-stand 20′. This in turn accommodates the roll-forming machine to use in conjunction with materials of various widths.

The roll-stand 20′ also incorporates advantages over the roll-stand 20. For example, because it is entirely self-contained, the roll-stand 20′ provides greater flexibility with respect to the number and the placement of roll-stands in a roll-forming machine. Another advantage relates to the fact that additional roll-stands may be added to existing machines with relatively little expense.

Figure 6:
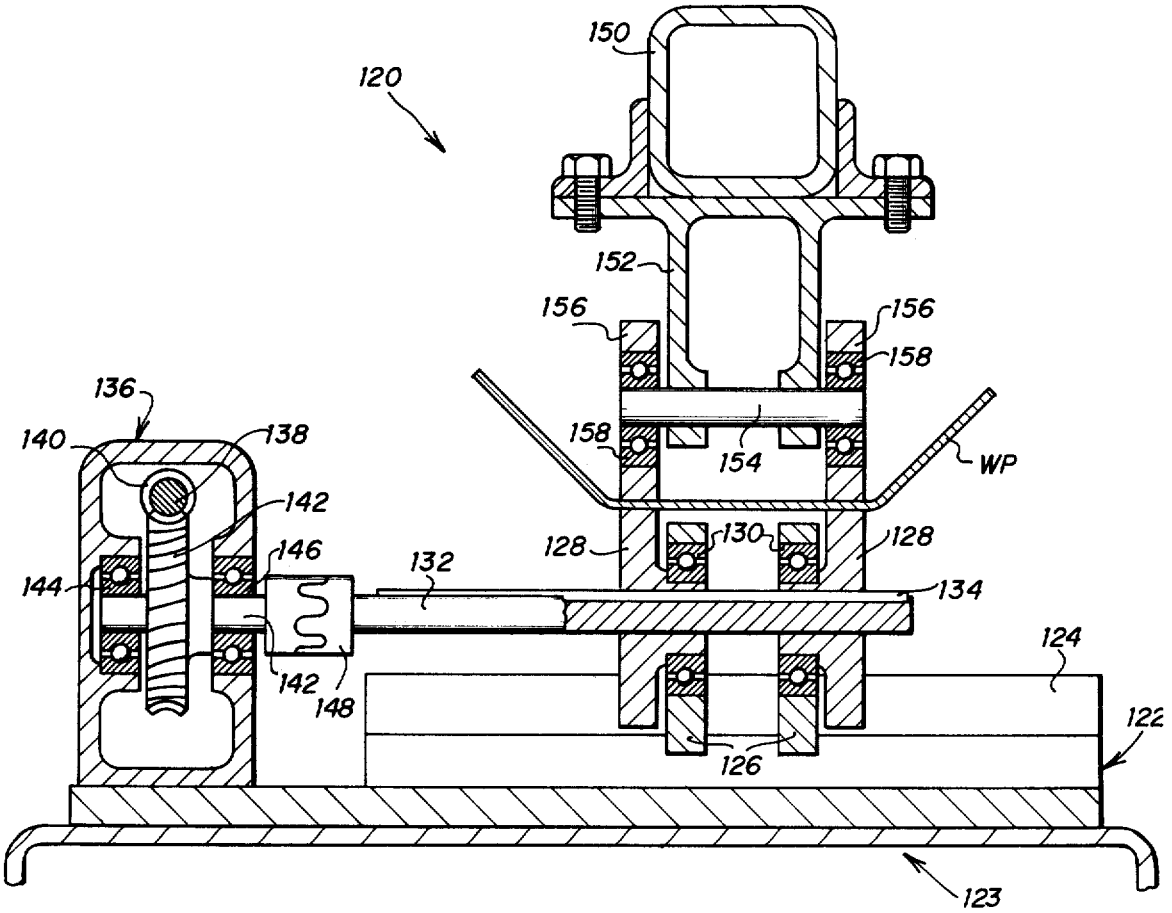
FIG. 6 is an illustration of a roll-stand incorporating a third embodiment of the invention in which certain parts have been broken away.

FIG. 6 illustrates a roll-stand 120 incorporating a third embodiment of the invention. The roll-stand 120 includes a base 122 which is mounted on the frame 123 of a roll-forming machine incorporating the roll-stand. The base 122 has a pair of opposed ways 124 formed integrally therewith. The ways 124 may be constructed as illustrated in FIG. 2 in connection with the roll-forming machine 20.

A pair of bearing blocks 126 are slidably received in the ways 124 of the base 122 but are normally secured against relative motion with respect to the base 122 by set screws or the like. A pair of lower rollers 128 are rotatably supported in the bearing blocks 126 by anti-friction bearings 130. A drive shaft 132 extends through both of the rollers 128. A key 134 received in keyways formed in the rollers 128 and in the drive shaft 132 is utilized to constrain the rollers 128 to rotation with the shaft 132 while facilitating selective positioning of the rollers 128 axially along the shaft 132.

A gearbox 136 is mounted on the base 122 and has a worm shaft 138 extending through it. A worm 140 is mounted on and driven by the shaft 138, and a worm wheel 142 is mounted in mesh with the worm 140. The worm wheel 142 is secured to a shaft 144 which is rotatably supported in the gearbox 136 by means of anti-friction bearings 146. The shaft 144 is connected to the drive shaft 132 by a coupler 148. Thus, by simply disconnecting the coupler 148, the operating components of the roll-stand 120 may be disconnected from the components housed within the gearbox 136, such as for maintenance purposes, etc., and the entire roll-stand 120 (including the gearbox 136) may be removed from the frame 123 for maintenance or replacement, etc.

The roll-stand 120 is intended for use in a roll-forming machine of the type incorporating an elongate, rigid spine 150. The spine 150 supports a bracket 152 which in turn supports a shaft 154. A pair of idler or upper rollers 156 are rotatably supported on the shaft 154 by anti-friction bearings 158. Thus, a workpiece WP is received between the idler rollers 156 and the lower rollers 128 and is driven through a roll-forming machine incorporating the roll-stand 1 20 under the action of the lower rollers 128.

Those skilled in the art will appreciate the fact that the roll-stand 120 incorporates numerous advantages over the prior art. Thus, because the lower rollers 128 may be located at predetermined positions transversely with respect to the path of material movement through a roll-forming machine, the use of the roll-stand 120 adapts the roll-forming machine to use with materials of various widths. Another advantage relates to the fact that the upper rollers 156 of the roll-stand 120 comprise idler rollers. Since the shaft 154 does not comprise a drive shaft, this feature permits the use of the roll-stand 20 with a workpiece having substantially greater depth than would otherwise be possible.

Figure 7:
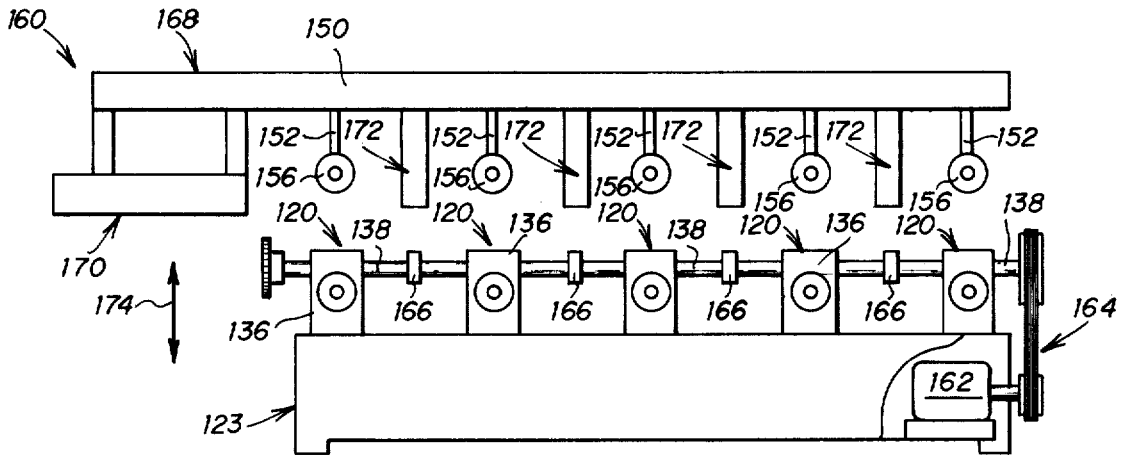
FIG. 7 is a somewhat diagrammatic illustration of a roll-forming machine incorporating roll-stands of the type shown in FIG. 6.

Referring to FIG. 7, there is shown a roll-forming machine 160 incorporating a plurality of roll-stands 120 of the type shown in FIG. 4. The roll-stands 120 are supported on a common frame 123 which also supports the remaining components of the roll-forming machine 160. A motor 162, which may comprise an electric motor, a hydraulic motor, a pneumatic motor, etc., is mounted on the frame 123 and is drivingly connected to the worm shaft 138 of the endmost roll-stand 120 by a V-belt drive 164. The worm shafts 138 of the remaining roll-stands 120 are in turn connectd one to the other by means of a plurality of conventional connectors 166.

The roll-forming machine 160 further includes a spine/die-stand assembly 168. The assembly 168 includes the spine 150 which supports a guide assembly 170 and a plurality of die-stands 172. The spine 150 also supports the upper rollers 156 of the roll-stands 120 by means of the brackets 152.

As is indicated in the arrow 174, the spine/die-stand assembly 168 is received on the frame 123 and functions to position the guide assembly 170, the die-stands 172, and the upper or idler rollers 156 with respect to the remaining components of the roll-stands 120. When the spine/die-stand assembly 168 is properly positioned in the roll-froming machine 168, the guide assembly 170 and the roll-stands 120 function to define a predetermined path of movement for material through the roll-forming machine. The roll-stands 120 also function to drive the material along a predetermined path. As the material moves through the roll-forming machine, the non-driven material engaging rollers of the die-stands 172 function to transform the material from an initial configuration to a desired configuration.

Whenever it is desired to convert the roll-forming machine 168 to a different roll-forming configuration, the entire spine/die-stand assembly 168 is disengaged from the frame 123 and is removed from the roll-forming machine 160 in the manner indicated by the arrow 174. A different spine/die-stand assembly 168 is then positioned in the roll-forming machine 160. At this point, the roll-forming machine 160 is ready to perform an entirely different roll-forming operation. It will be understood that each spine/die-stand assembly 168 intended for use in the roll-forming machine 160 is provided with its own set of upper rollers 156 which are intended for use in conjunction with a particular roll-forming operation. A more complete understanding of the construction and operation of the roll-forming machine 160 may be had by referring to co-pending application Ser. No. 355,673, now U.S. Pat. No. 3,823,592, the disclosure of which is incorporated herein by reference.

Figure 8:
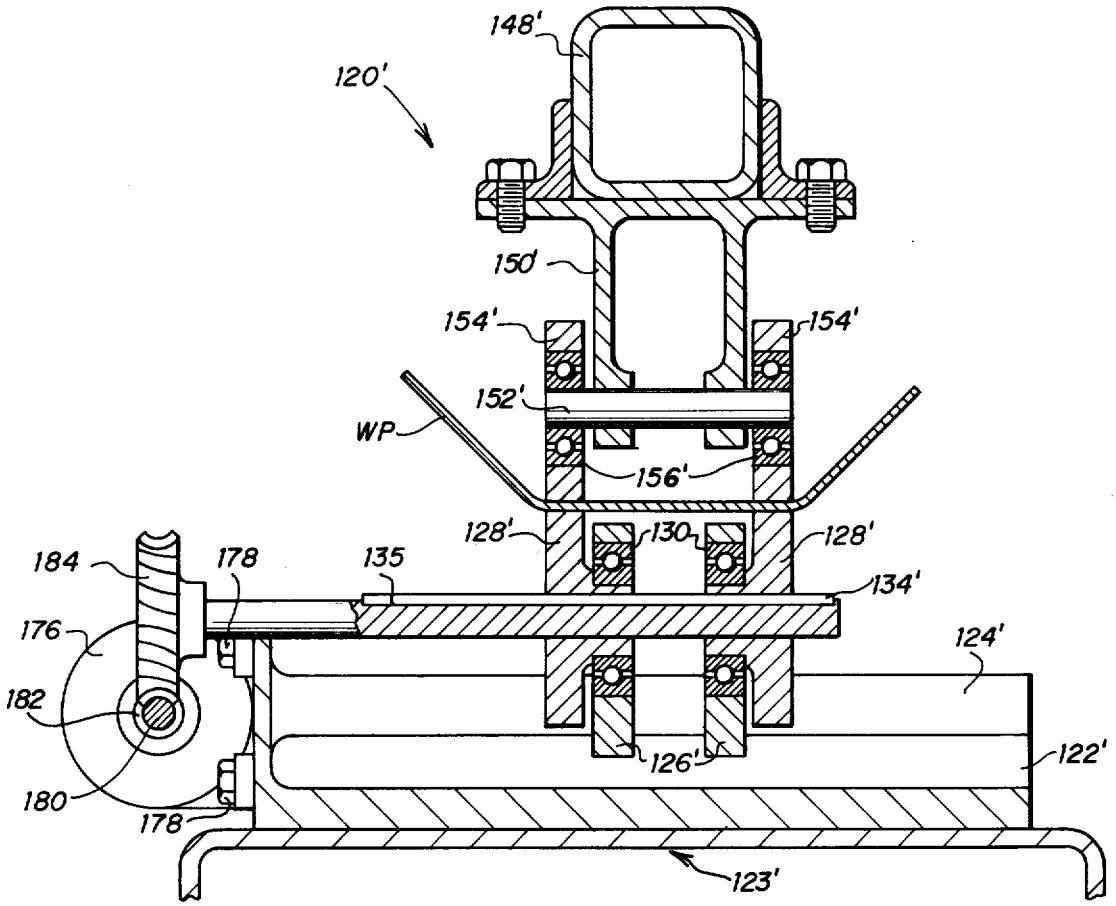
FIG. 8 is an illustration of a roll-stand incorporating a fourth embodiment of the invention in which certain parts have been broken away.

In FIG. 8 there is shown a roll-stand 120' incorporating a fourth embodiment of the invention. The roll-stand 120' comprises numerous component parts which are substantially identical in construction and function to component parts of the roll-stand 120 shown in FIG. 6. These equivalent parts are identified by identical reference numerals utilized hereinbefore in the description of the roll-stand 120 with the parts of the roll-stand 120' being differentiated from the parts of the roll-stand 120 by a prime (') designation.

The primary difference between the roll-stand 120' and the roll-stand 120 relates to the fact that rather than being actuated by a common drive system, the roll-stand 120' employs a drive motor 176 individual to it. The drive motor 176 may comprise an electric motor, a hydraulic motor, a pneumatic motor, etc. The motor 176 is secured to the base 122' by a plurality of fasteners 178 and has an output shaft 180. A worm 182 is mounted on and driven by the shaft 180, and the worm wheel 184 is mounted in mesh with the worm 182. Thus, the motor 176 operates through the shaft 180, the worm 182, the worm wheel 184 and the drive shaft 132' to rotate the lower rollers 128'.

The roll-stand 120' incorporates the same advantages over the prior art as the roll-stand 120. Thus, the lower rollers 128' may be located in predetermined positions transversely with respect to the path of material movement through a roll-forming machine incorporating roll-stands. By this means the roll-forming machine is adapted for use in conjunction with materials of various widths. Also since the shaft 154' which supports the upper rollers 156' does not comprise a drive shaft, the depth of the workpiece WP which is driven by the roll-stand 120' is virtually unlimited.

The roll-stand 120' also incorporates certain advantages over the roll-stand 120. Thus, the self-contained nature of the roll-stand 120' greatly simplifies the location and particularly the relocation of the roll-stand in a roll-forming machine. Another advantage involves the fact that additional roll-stands may be added to an existing roll-forming machine with relatively little difficulty or cost.

Figures 9, 10:
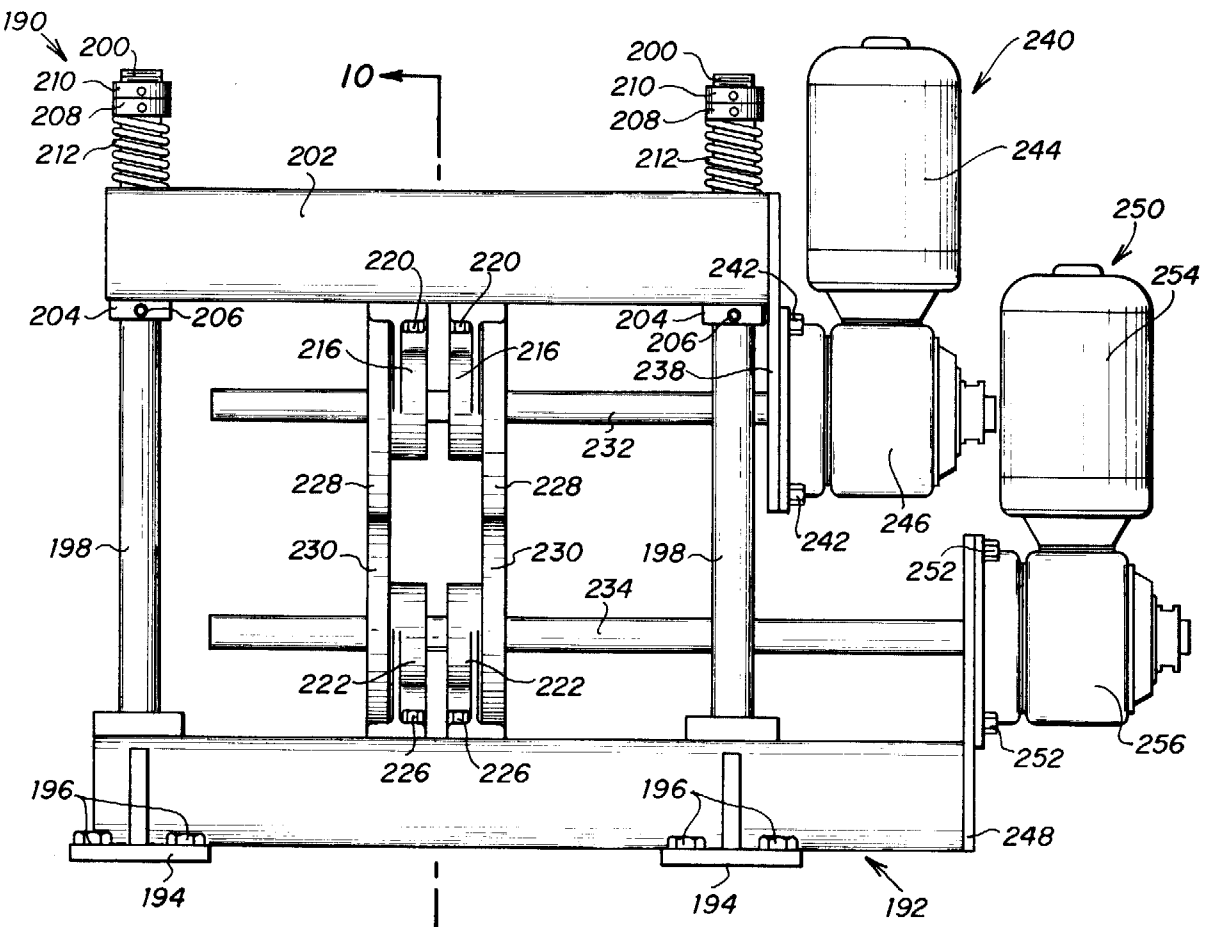
FIG. 9 is an illustration of a roll-stand incorporating a fifth embodiment of the invention.
FIG. 10 is a sectional view taken along the line 10—10 in FIG. 9 in the direction of the arrows.

Referring to FIG. 9, there is shown a roll-stand 190 comprising a fifth embodiment of the invention. The roll-stand 190 includes a base 192 having a plurality of mounting feet 194. This facilitates the mounting of the roll-stand 190 on the frame of a roll-forming machine by means of fasteners 196 engaged with the mounting feet 194.

The base 192 of the roll-stand 190 further includes four vertically extending guide posts 198. Each guide post 198 has a threaded portion 200 formed at its extreme upper end. A cap piece 202 is slidably supported on the guide posts 198. Downward movement of the cap piece 202 is limited by collars 204 secured in place on the guide posts 198 by set screws 206 or the like.

A nut 208 and a lock nut 210 are threadedly engaged with the threaded portion 200 of each guide post 198. A compression spring 212 is positioned between each nut 208 and the cap piece 202. By this means the cap piece 202 is permitted to slide upwardly on the guide posts 198 against the action of the springs 212.

Referring now to FIG. 10, the cap piece 202 has a channel-shaped cross-section. The frame 192 includes a portion 214 having a substantially identical cross-section. A pair of upper bearing blocks 216 are secured to the cap piece 202 by L-shaped clamps 218 and fasteners 220. Similarly, a pair of identical lower bearing blocks 222 are secured to the portion 214 of the base 192 by identical L-shaped clamps 224 and fasteners 226.

A pair of upper rollers 228 are each rotatably supported on one of the upper bearing blocks 216. Similarly, a pair of lower rollers 230 are each rotatably supported on one of the lower bearing blocks 222. An upper drive shaft 232 extends through both of the upper rollers 228, and the lower drive shaft 234 extends through both of the lower rollers 230. Keys 236 are utilized to constrain the rollers 228 and 230 to rotation with the drive shafts 232 and 234, respectively.

Referring again to FIG. 9, a bracket 238 depends from a cap piece 202. A gearmotor 240 is secured to the bracket 238 by means of fasteners 242. The gearmotor 240 includes a motor portion 244 and a gearbox portion 246 drivingly connected to the motor portion 244. The gearbox portion 246 is in turn drivingly connected to the drive shaft 232 and hence to the upper rollers 228. Thus, the gearmotor 240 functions to rotate the upper rollers 228.

A bracket 248 extends upwardly from the base 192. A gearmotor 250 is secured to the bracket 248 by fasteners 252. The gearmotor 252 includes a motor portion 254 having an output drivingly connected to a gearbox portion 256. The gearbox portion 256 is in turn drivingly connected to the lower drive shaft 234 and hence to the lower rollers 230. Thus, the gearmotor 250 functions to effect rotation of the lower rollers 230.

The primary advantage deriving from the use of the roll-stand 190 relates to the fact that by loosening the bolts 220 and 226, the upper rollers 228 and the lower rollers 230 may be selectively located at predetermined points transversely with respect to the path of material movement through a roll-forming machine. By this means the roll-forming machine is adapted for use in conjunction with materials of various widths. Another advantage relates to the fact that the roll-stand 190 is entirely self-contained. This has been found to be advantageous both with respect to the repositioning of roll-stands in a roll-forming machine and with respect to adding additional roll-stands to existing roll-forming machines.

Figure 13:
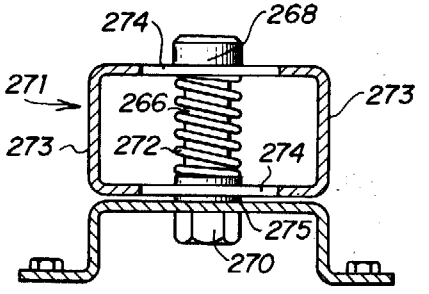
FIG. 13 is a sectional view taken along the line 13—13 in FIG. 11 in the direction of the arrows.
Figure 11:
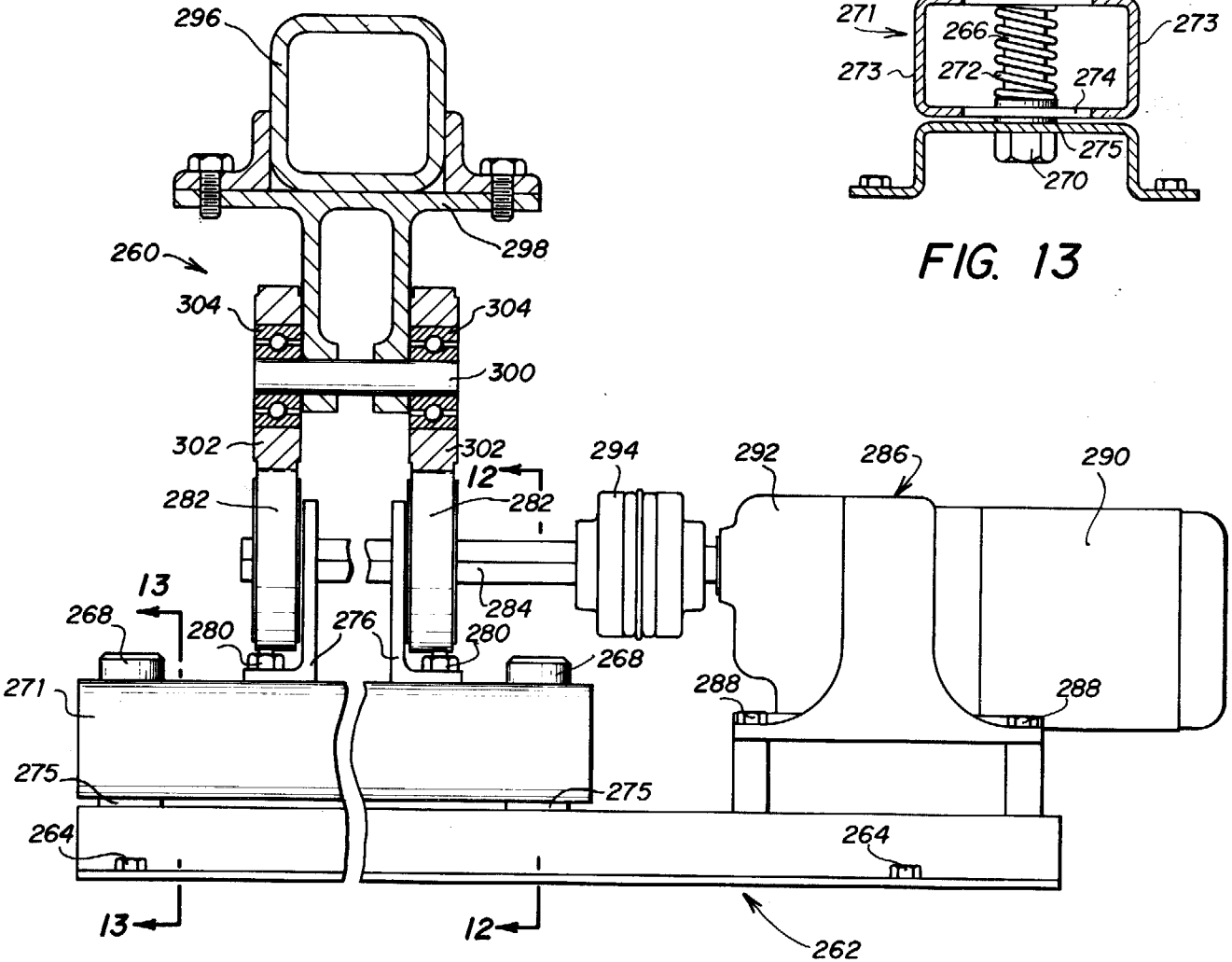
FIG. 11 is an illustration of a roll-stand incorporating a sixth embodiment of the invention in which certain parts have been broken away.
Figure 12:
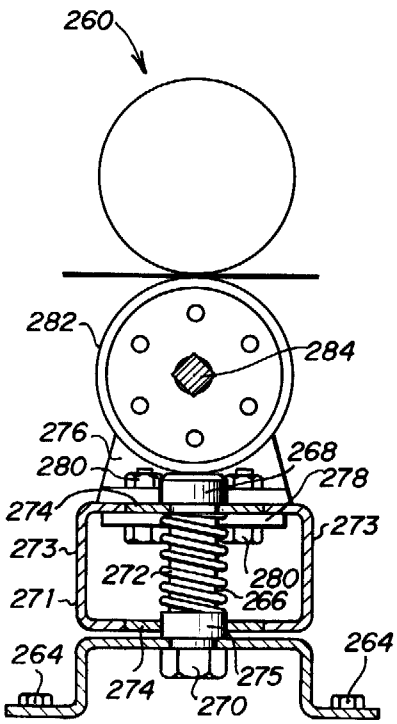
FIG. 12 is a sectional view taken along the line 12—12 in FIG. 11 in the direction of the arrows.

A roll-stand 260 incorporating the sixth embodiment of the invention is illustrated in FIGS. 11, 12 and 13. The roll-stand 260 includes a base 262 adapted to be mounted on the frame of a roll-forming machine by means of fasteners 264. The base 262 includes a pair of vertically extending guide posts 266, each having a head 268 at its upper end. A pair of nuts 270 are threadedly engaged with the lower ends of the guide posts 266.

A member 271 is slidably supported on the guide posts 266. The member 271 is normally positioned as shown in FIG. 12 by a pair of compression springs 272. This permits the member 271 to move downwardly on the guide posts 266 against the action of the springs 272.

Referring to FIG. 13, the member 271 is comprised of a pair of channel members 273 connected together with two pairs of plates 274 top and bottom at both ends. The top plates 274 have holes to fit guide posts 268. The bottom plates 274 have holes to fit spacers 275. Springs 272 press member 271 up against the head 268.

A pair of bearing blocks 276 are secured to the member 272 by a pair of clamps 278 and fasteners 280. The bearing blocks 276 rotatably support a pair of lower rollers 282. A drive shaft 284 extends through both of the lower rollers 282. The drive shaft 284 is non-circular in cross-section, whereby the lower rollers 282 are constrained to rotation with the drive shaft 284.

A gearmotor 286 is supported on the base 282 and is secured thereto by fasteners 288. A gearmotor 286 includes a motor portion 290 having an output drivingly connected to a gearbox portion 292. The output of the gearbox portion 292 is in turn connected to a flexible coupling 294. The flexible coupling 294 is connected to the drive shaft 284 and hence to the lower rollers 282. Thus, the gearmotor 286 operates through the flexible coupling 294 and the drive shaft 284 to effect rotation of the lower rollers 282.

The roll-stand 260 is utilized in conjunction with a roll-forming machine of the type including an elongate rigid spine 296. The spine 296 supports a bracket 298 which in turn supports a shaft 300. A pair of upper or idler rollers 302 for the roll-stand 260 are rotatably supported on the shaft 300 by means of anti-friction bearings 304. The rollers 302 are positioned in alignment with the lower rollers for cooperation with to effect movement of material through a roll-forming machine under the action of the gearmotor 286.

The roll-stand 260 incorporates numerous advantages over the prior art. First, the lower rollers 282 of the roll-stand may be selectively located in predetermined positions transversely with respect to the path of material movement through a roll-forming machine. By this means the roll-forming machine is adapted for use in conjunction with materials of various widths. Second, the lower rollers 282 are adapted to float downwardly against the action of the springs 272. By this means a roll-forming machine incorporating the roll-stand is adapted for use in conjunction with material of various thicknesses. Third, since the shaft 300 does not extend beyond the rollers 302, workpieces of virtually any depth can be accommodated in the roll-stand. Finally, it will be appreciated that the roll-stand 260 is entirely self-contained. This is highly advantageous both with respect to relocating roll-stands in existing roll-forming machines and with respect to adding additional roll-stands to existing roll-forming machines.

From the foregoing it will be understood that the present invention relates to improvements in roll-stands for roll-forming machines incorporating numerous advantages over the prior art. Perhaps the primary advantage deriving from the use of the invention relates to the fact that roll-stands constructed in accordance therewith comprise at least lower rollers which are selectively positionable transversely with respect to the path of material movement through a roll-forming machine. By this means the roll-forming machine is adapted for use in conjunction with material of various widths. Certain embodiments of the invention relate to roll-stands in which the upper rollers are supported on the elongate rigid spine of the roll-forming machine. This is advantageous in simplifying and reducing the cost of the roll-stand, and also in that it permits workpieces of virtually unlimited depth to be accommodated in the roll-stand. Finally, certain embodiments of the invention incorporate individual drive motors and are therefore entirely self-contained. This is advantageous in that it facilitates both the relocation of roll-stands and the use of additional roll-stands in existing roll-forming machines.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. In a roll-forming machine of the type including means defining the path of material to be formed, a plurality of die-stands positioned at spaced points along the path for progressively transforming material from an initial configuration to a desired configuration, and a plurality of roll-stands positioned at spaced points along the path for driving material therealong and through the die-stands, each of said roll-stands comprising at least one non-forming lower roller and power means for actuating the lower roller, the improvement comprising means for selectively locating at least the lower roller of each roll-stand in predetermined positions transversely with respect to the path and thereby accommodating materials of various widths in the roll-forming machine.

2. In a roll-forming machine of the type including means defining the path of material to be formed, a plurality of die-stands positioned at spaced points along the path for progressively transforming material from an initial configuration to a desired configuration, and a plurality of roll-stands positioned at spaced points along the path for driving material therealong and through the die-stands, each of said roll-stands comprising at least two lower rollers and power means for actuating the lower rollers, the improvement comprising means for selectively locating at least the lower rollers of each roll-stand in predetermined positions transversely with respect to the path and thereby accommodating materials of various widths in the roll-forming machine, and further characterized by a drive shaft extending through the lower rollers of each roll-stand and means constraining both of the lower rollers of each roll-stand to rotation with the drive shaft extending therethrough.

3. In a roll-forming machine of the type including means defining the path of material to be formed, a plurality of die-stands positioned at spaced points along the path for progressively transforming material from an initial configuration to a desired configuration, and a plurality of roll-stands positioned at spaced points along the path for driving material therealong and through the die-stands, each of said roll-stands comprising at least one lower roller and power means for actuating the lower roller, the improvement comprising means for selectively locating at least the lower roller of each roll-stand in predetermined positions transversely with respect to the path and thereby accommodating materials of various widths in the roll-forming machine, and further comprising at least one upper roller and means for selectively locating the upper roller of each roll-stand in alignment with the lower roller thereof.

4. The improvement according to claim 3 wherein the upper roller positioning means is further characterized by a drive shaft extending through the upper roller of each roll-stand and means constraining the upper roller of each roll-stand to rotation with the drive shaft extending therethrough.

5. The improvement according to claim 1 wherein the roll-forming machine further includes an elongate, rigid spine which supports the die-stands and wherein each roll-stand is further characterized by at least one ldler roller mounted on the spine for cooperation with the lower roller to drive material through the roll-forming machine.

6. A roll-forming machine comprising:

a base;

a plurality of roll-stands mounted on the base at spaced points along a predetermined path and each comprising at least one non-forming lower roller for driving material along the path;

power means for actuating at least the lower roller of the roll-stands and thereby advancing the material along the predetermined path;

a plurality of die-stands positioned at spaced points along the path for progressively transforming material moving along the path from an initial configuration to a desired configuration and each comprising at least one non-driven material engaging roller; and means for selectively locating the lower roller of each roll-stand in predetermined positions transversely with respect to the path of material movement and thereby accommodating materials of various widths in the roll-forming machine.

7. The roll-forming machine according to claim 6 further characterized by a plurality of non-forming upper rollers each positioned for cooperation with the lower roller of one of the roll-stands to receive material therebetween and thereby drive the material along the predetermined path.

8. The roll-forming machine according to claim 7 further characterized by:

an elongate spine extending adjacent to the predetermined path; and means rigidly securing each of the die-stands to the spine.

9. The roll-forming machine according to claim 8 further characterized by means secured to the spine for positioning the upper rollers with respect to the lower roller of the roll-stands, and for rotatably supporting each upper roller.

10. The roll-forming machine according to claim 7 wherein each roll-stand is further characterized by means supporting the upper roller for cooperation with the lower roller of the roll-stand to receive material therebetween and means for selectively locating the upper roller in a predetermined position transversely with respect to the path.

11. The roll-stand according to claim 10 wherein each roll-stand further includes:

upper and lower drive shafts extending through the upper and lower roller of the roll-stand, respectively;

means constraining the upper roller to rotation with the upper drive shaft; and means constraining the lower roller to rotation with the lower drive shaft.

12. The roll-stand according to claim 11 further characterized by means floatingly supporting the upper roller and thereby accommodating materials of various thicknesses in the roll-forming machine.

13. A roll-forming machine comprising:

a base;

a plurality of roll-stands mounted on the base at spaced points along the predetermined path and each comprising at least two non-forming lower rollers and at least two non-forming upper rollers positioned for cooperation with the lower rollers to receive and drive materials therebetween;

power means for actuating the upper and lower rollers of the roll-stands and thereby advancing material along the predetermined path;

means for selectively locating the upper and lower rollers of each roll-stand in predetermined positions transversely with respect to the predetermined path and thereby accommodating material of various widths in the roll-forming machine; and a plurality of die-stands positioned at spaced points along the path of progressively transforming material moving along the path from an intial configuration to a desired configuration and each comprising at least one non-driven material engaging roller.

14. The roll-forming machine according to claim 13 further including means floatingly supporting the upper rollers of each roll-stand and thereby accommodating materials of various thicknesses in the roll-forming machine.

15. The roll-forming machine according to claim 14 wherein each roll-stand of the roll-forming machine is further characterized by:

upper and lower drive shafts extending through the upper and lower rollers, respectively;

means constraining the upper rollers to rotation with the upper drive shaft; and means constraining the lower rollers to rotation of the lower drive shaft.

16. The roll-forming machine according to claim 15 wherein the power means is further characterized by:

common drive means for all of the roll-stands; and means drivingly connecting the upper and lower drive shafts of each roll-stand to the common drive means.

17. The roll-forming machine according to claim 15 wherein the power means is further characterized by:

a plurality of drive motor means each individual to one of the drive shafts of one of the roll-stands and each having an output; and means drivingly connecting the output of each drive motor means to its associated drive shaft.

18. The roll-forming machine according to claim 15 further characterized by:

a plurality of bearing means each rotatably supporting one of the rollers; and means for selectively securing each bearing means in a predetermined position transversely with respect to the predetermined path.

19. A roll-forming machine comprising:

a frame;

an elongate, rigid spine;

a plurality of die-stands each secured to the spine and positioned thereby at spaced points along a predetermined path and each comprising at least one roller mounted for engagement with material moving along the predetermined path to at least partially transform the material to an initial configuration to a desired configuration;

a plurality of roll-stands mounted on the frame at spaced points along the predetermined path and each comprising a pair of lower rollers supported on a base for engagement with material moving along the predetermined path and at least one roller mounted on the spine and positioned thereby for cooperation with the lower rollers to receive material therebetween;

power means for actuating the lower rollers of each roll-stand and thereby advancing material along the predetermined path; and means for selectively locating the lower rollers of each roll-stand in predetermined positions transversely with respect to the predetermined paths and thereby accommodating materials of various widths in the roll-forming machine.

20. The roll-forming machine according to claim 19 wherein each roll-stand further includes:

a drive shaft extending through both of the lower rollers of the roll-stand; and means constraining the lower rollers of the roll-stand to rotation with the drive shaft extending therethrough.

21. The roll-forming machine according to claim 20 wherein the power means is further characterized by:

common drive means for actuating all of the roll-stands; and means drivingly connecting the drive shaft of each roll-stand to the common drive means.

22. The roll-forming machine according to claim 20 wherein the power means is further characterized by:

a plurality of drive motor means each individual to one of the roll-stands; and means drivingly connecting the drive shaft of each roll-stand to its associated drive motor means.

23. The roll-forming machine according to claim 20 wherein each roll-stand is further characterized by:

a pair of bearing means each rotatably supporting one of the lower rollers; and means for selectively securing each bearing means on the frame in a predetermined position transversely with respect to the predetermined path.

24. The roll-forming machine according to claim 20 further characterized by means floatingly supporting the lower rollers and thereby accommodating materials of various thicknesses in the roll-forming machine.

25. For use in a roll-forming machine of the type in which material moving along a predetermined path is progressively transformed from an initial configuration into a desired configuration, a roll-stand comprising:

a base;

a pair of lower rollers;

means supporting the lower rollers on the base for engagement with material moving along the predetermined path of thr roll-forming machine;

power means for actuating the lower rollers and thereby propelling the material along the predetermined path;

means for selectively locating the lower rollers at predetermined positions transversely relative to the predetermined path and thereby accommodating materials of various widths in the roll-forming machine;

a pair of upper rollers;

means supporting the upper rollers for cooperation with the lower rollers to receive material traveling along the predetermined path therebetween;

a drive shaft extending through both of the lower rollers;

means constraining the lower rollers to rotation with the drive shaft;

bearing means rotatably supporting each of the lower rollers; and means for selectively securing each bearing means in a predetermined location transversely with respect to the predetermined path.

26. The roll-stand according to claim 25 further including drive motor means mounted on the frame and having an output and means drivingly interconnecting the output of the drive motor means to the drive shaft extending through the lower rollers.

27. The roll-stand according to claim 25 further characterized by means floatingly supporting at least one of the pairs of rollers and thereby accommodating materials of various thicknesses therebetween.

* * * * *